United States Patent [19]

Taylor

[11] Patent Number: 5,069,282

[45] Date of Patent: Dec. 3, 1991

[54] MECHANICAL DOWN JAR MECHANISM

[76] Inventor: William T. Taylor, 1412 Cottage Dr., Houma, La. 70360

[21] Appl. No.: 625,113

[22] Filed: Dec. 10, 1990

[51] Int. Cl.[5] ..... E21B 31/113

[52] U.S. Cl. ..... 166/301; 166/178

[58] Field of Search ..... 166/301, 178; 175/297, 175/296

[56] References Cited

U.S. PATENT DOCUMENTS

| | | | |
|---|---|---|---|
| 4,098,338 | 7/1978 | Perkins | 166/301 |
| 4,658,901 | 4/1987 | Alexander | 166/301 |
| 4,736,797 | 4/1988 | Restarick, Jr. et al. | 166/301 |
| 5,007,479 | 4/1991 | Pleasants et al. | 166/301 X |

*Primary Examiner*—Thuy M. Bui

*Attorney, Agent, or Firm*—James L. Jackson

[57] ABSTRACT

A mechanical down jar and method for its use in connection with coil tubing and with jointed tubing for releasing stuck objects within a well bore for installing coil tubing within deviated and horizontal well bores and for conducting other downhole servicing operations. The mechanical down jar mechanism incorporates a tubular body of significant mass having fixed anvils and telescoping mandrels at each end. The lower mandrel is adapted for connection to the stuck object. An internal load spring is released upon application of predetermined downward force to the housing by a firing lug and firing ring release mechanism having an adjustable release force. When released the housing with its lower anvil is rapidly moved downwardly by the force of the load spring and an accelerator spring impacts with signficant force against the force transmitting sub of the lower mandrel thus transmitting downwardly directed shock force to the stuck object or to tubing to be moved downwardly. By simple linear reciprocating movement of the jar operating tubing one or more down jars may be repeatedly recooked and fired as many times as is desired to move the object downwardly to the desired location within the well bore.

14 Claims, 5 Drawing Sheets

MECHANICAL DOWN JAR MECHANISM

FIELD OF THE INVENTION

This invention relates generally to jarring mechanisms for use in well drilling and well servicing operations and more particularly concerns a mechanical down jar mechanism that is especially suitable for jarring activities in connection with coil tubing though it is quite acceptable for other down jarring activities and for use in combination with devices achieving upward jarring activities as well.

BACKGROUND OF THE INVENTION

Although the present invention is discussed herein, particularly as it relates to down jarring activities in connection with coil tubing, it should be born in mind that this jarring mechanism is also capable of efficient use in connection with conventional jointed tubing for jarring activities. Further, the telescoping components of this down jar mechanism may be provided with splined interconnection so as to be efficiently used for snubbing or drilling activities and it may be used to release locking mandrels, broaching tools, shear pins, etc. It may also be employed in combination with an up jarring mechanism or with an accelerator to enhance jarring activities. This jarring mechanism may also be employed for fishing activities, wherein objects that are stuck within the well bore (fish) are released by jarring activities so that they can be removed from the well.

Coil tubing fishing is becoming very popular with the oil industry due to the speed of getting the tubing into and out of the well bore, plus its ability to pull and circulate with high pressure, such as for cleaning the top of a fish to facilitate a fishing operation. It is desirable, therefore, to provide a mechanical down jarring mechanism that is capable of functioning to achieve jarring activities that are especially suitable for coil tubing. It is also desirable to provide a jarring mechanism that functions efficiently during horizontal drilling activities and for work over activities for petroleum wells.

It is well known that fishing activities are exceedingly difficult where coil tubing is involved. In approximately 50% of the cases, it is impossible where coil tubing is being employed to release the fishing tools due to the inability to develop a downwardly directed jarring or shock load on the fishing tool to release it from the fish. Coil tubing units are hydraulic and can not move downward with adequate motion to generate a shock load to fishing tools. All fishing tools, after having been jarred on for some time with upwardly directed jarring force, require downward shock impact for releasing. Jarring down is also necessary to free the fish from the fishing tool.

The inventor of the subject matter hereof is considered the leader or pioneer in the industry to introduce vertical release and catch, on/off fishing tools for the purpose of coil tubing fishing. These technological advancements in fishing tools and fishing technology are considered especially important because coil tubing can not be rotated. Rather, coil tubing is inserted linearly into the well bore. In order to accomplish downward fishing operations with coil tubing, it becomes very necessary to develop a down jar to complete the fishing string in order to release fishing tools should the operator be unable to retrieve the fish.

Until now, the operator of the fishing equipment, in order to disengage coil tubing from fishing tools, will pump a steel ball down the coil tubing to actuate a tool release mechanism. After this has been done, the operator will then install wireline fishing equipment and enter the well with spang or tubular jars to release the fishing tool. These necessary activities become a great hindrance to the commercial success of fishing operations because of the time and expense that is involved.

SUMMARY OF THE INVENTION

It is a principal feature of the present invention therefore, to provide a novel mechanical down jar mechanism that is capable of functioning efficiently to achieve down jarring activities when coil tubing is being utilized for fishing operations in wells or is being employed in connection with horizontal drilling activities and workover operations.

It is another feature of this invention to provide a novel mechanical down jar mechanism designed particularly for coil tubing and which is also capable of being efficiently utilized for other down jarring activities when coil tubing is not being employed.

It is also a feature of this invention to provide a novel mechanical down jar mechanism that is capable of being utilized in connection with other jarring activities, such as with up jars, or with other mechanical devices such as accelerators, well drilling equipment, etc.

Other and further features of this invention will become apparent to one skilled in the art upon an understanding of the preferred embodiment set forth in detail hereinbelow.

Briefly, according to the present invention, a downjar mechanism is provided having a housing having a mandrel and top sub for connection with the jar operation mechanism of the drilling or workover rig. From the bottom of the housing projects another telescoping mandrel having a bottom sub that is adapted for connection to a fishing tool or to other downhole equipment as desired. The down jar mechanism may also be connected in tandem with another down jar mechanism so as to provide an accelerator-like activity during down jarring as appropriate to the job being undertaken.

Within the housing is located a load spring assembly employing Belleville springs or any other suitable springs to provide the spring load of the jar. To achieve selective release of the housing to permit sudden downward movement of the housing by the load spring assembly to achieve sudden jarring against the bottom sub and the object to which it is connected, the housing incorporates a detent body having spaced internal firing and recocking grooves formed in the internal cylindrical surface of the detent body and with a firing lug positioning land disposed between the firing and recocking grooves. The position of the detent body is adjustable linearly within the housing so as to control the release force of the firing mechanism and thus the jarring load of the jar mechanism. Internally of the detent body is provided a firing lug assembly and a firing ring which cooperate to release the load of the jar by releasing the spring assembly for expansion when the preset releasing or firing force has been exceeded. The housing further incorporates a recocking spring for recocking of the firing mechanism after firing has occurred. The down jar mechanism is capable of being repeatedly fired to achieve repeated down jarring of the fish or other object without encountering any excessive wear of the various components thereof.

Although the drawings set forth illustrate a preferred embodiment of the down jar mechanism that is designed for down jarring and linear pulling only, it should be born in mind that the present invention may be equally well incorporated for down jarring activities and for application of rotational force. For example, the housing and mandrels may incorporate a splined interconnection as shown by the alternative embodiment hereof, thereby facilitating application of rotary force so that the jar mechanism may be suited for snubbing or drilling activities.

The down jar mechanism of this invention is intended to be placed at any suitable location in the coil tubing string. In fact a plurality of substantially identical down jars constructed according to this invention may be placed at selected spaced locations along the length of the coil tubing to provide for installation of the coil tubing. This feature is especially desirable when coil tubing is inserted into deviated or horizontal well bores.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

IN THE DRAWINGS

Figure 1A:
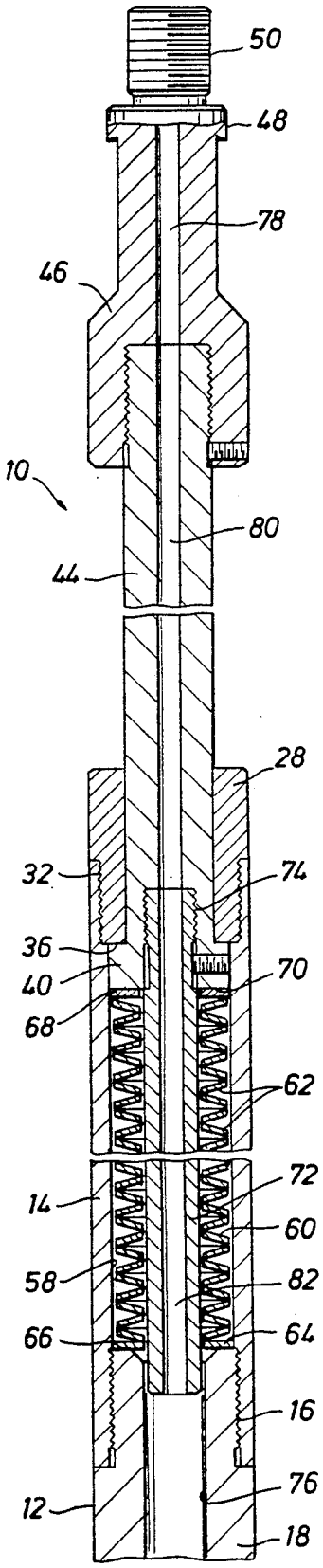

FIG. 1A is a sectional view of the upper portion of a mechanical down jar mechanism that is constructed in accordance with the teachings of the present invention.

Figure 1B:
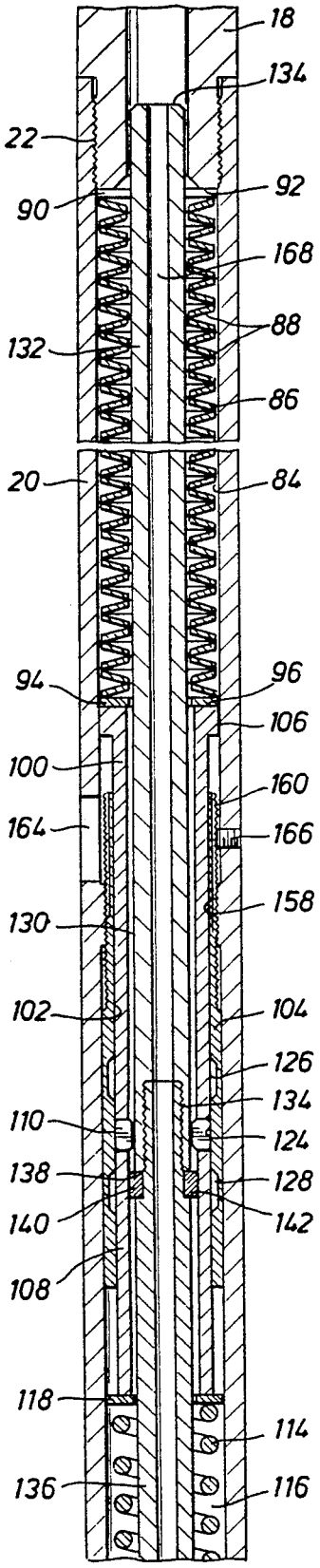

FIG. 1B is a sectional view of the intermediate portion of the down jar mechanism of FIG. 1A.

Figure 1C:
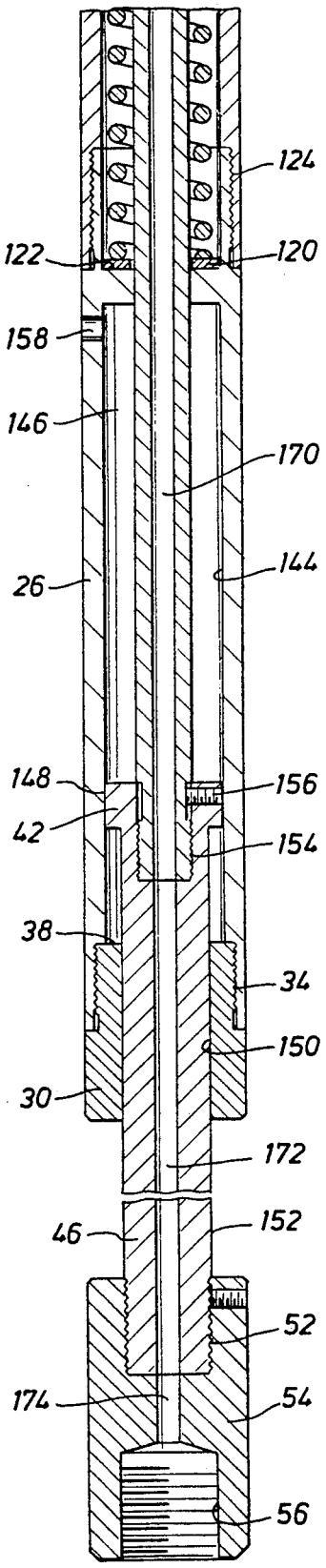

FIG. 1C is a sectional view of the lower portion of the mechanical down jar mechanism of FIGS. 1A and 1B.

Figure 2A:
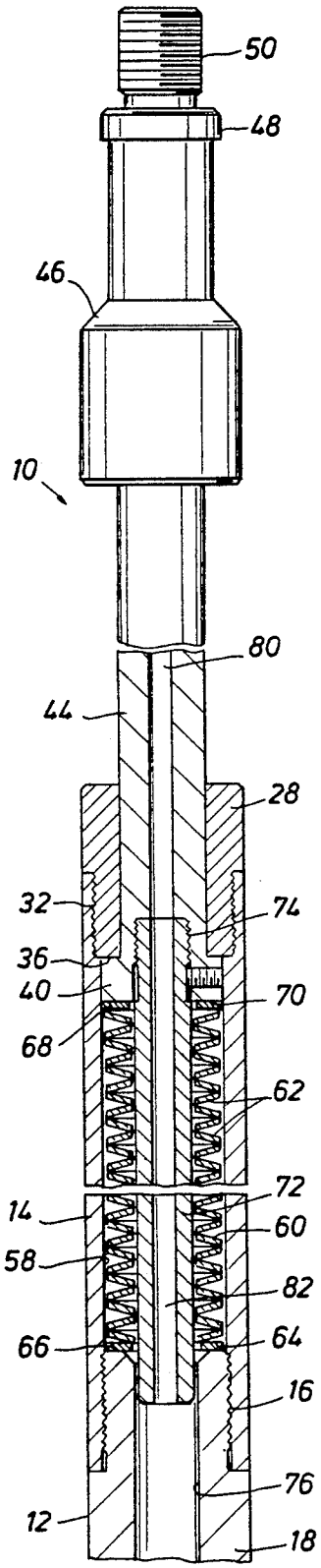

FIG. 2A is a sectional view of the upper portion of the down jar mechanism of FIGS. 1A, 1B and 1C with the mechanism being shown in its fired position.

Figure 2B:
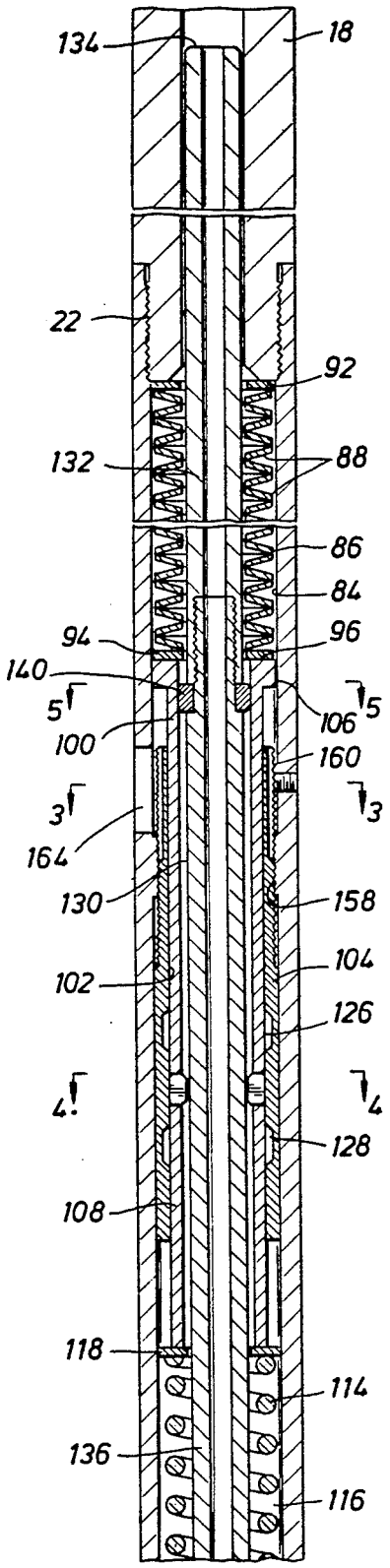

FIG. 2B is a sectional view of the intermediate portion of the down jar mechanism of FIG. 2A.

Figure 2C:
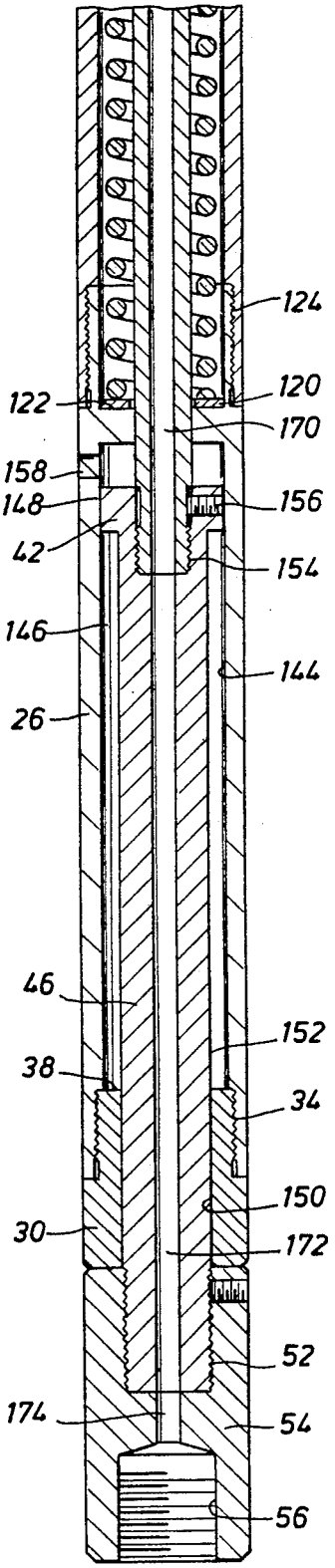

FIG. 2C is a sectional view of the lower portion of the down jar mechanism illustrating the components thereof in the "fired" condition.

Figure 3:
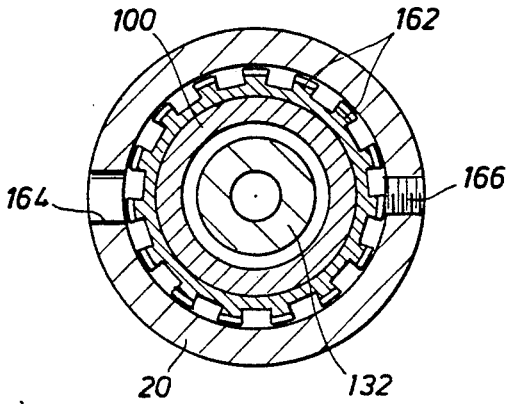

FIG. 3 is a sectional view taken along line 3—3 of FIG. 2B and illustrating the detent body adjustment in detail.

Figure 4:
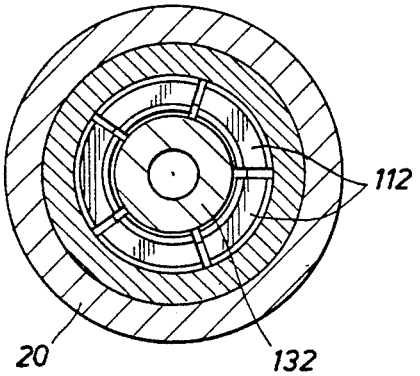

FIG. 4 is a sectional view taken along line 4—4 of FIG. 2B and illustrating the firing lug mechanism in detail.

Figure 5:
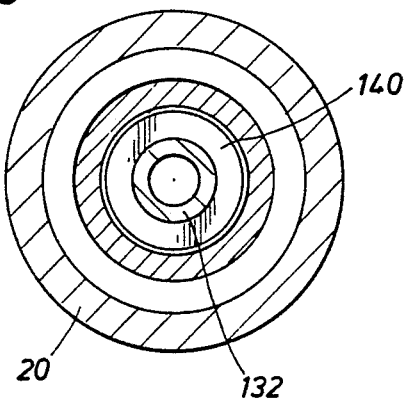

FIG. 5 is a sectional view taken along line 5—5 of FIG. 2B and illustrating the structure of the firing ring.

Figure 6:
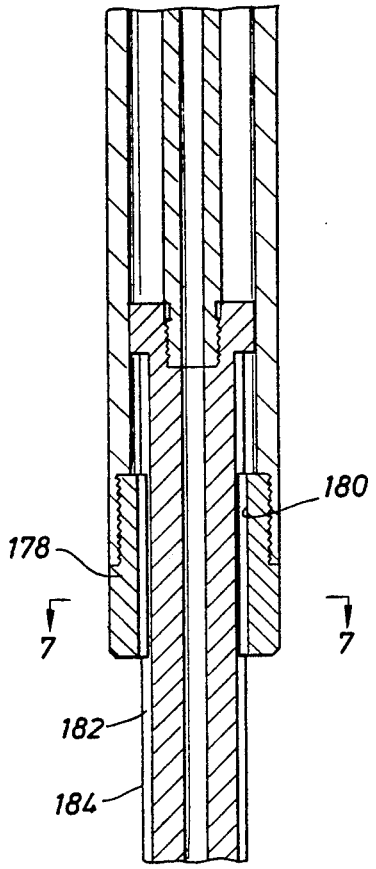

FIG. 6 is a fragmentary sectional view of a lower portion of a mechanical down jar mechanism representing an alternative embodiment of this invention and incorporating splined connections between the housing and telescoping upper and lower mandrels thereof.

Figure 7:
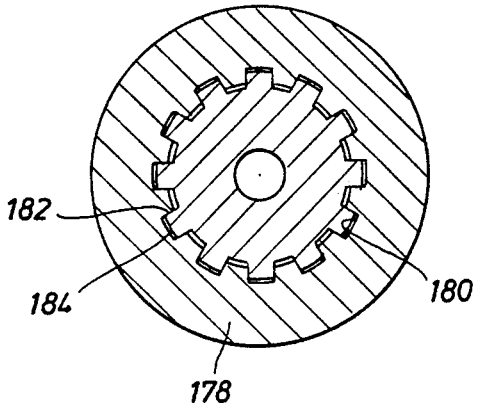

FIG. 7 is a sectional view taken along line 7—7 of FIG. 6.

Figure 8:
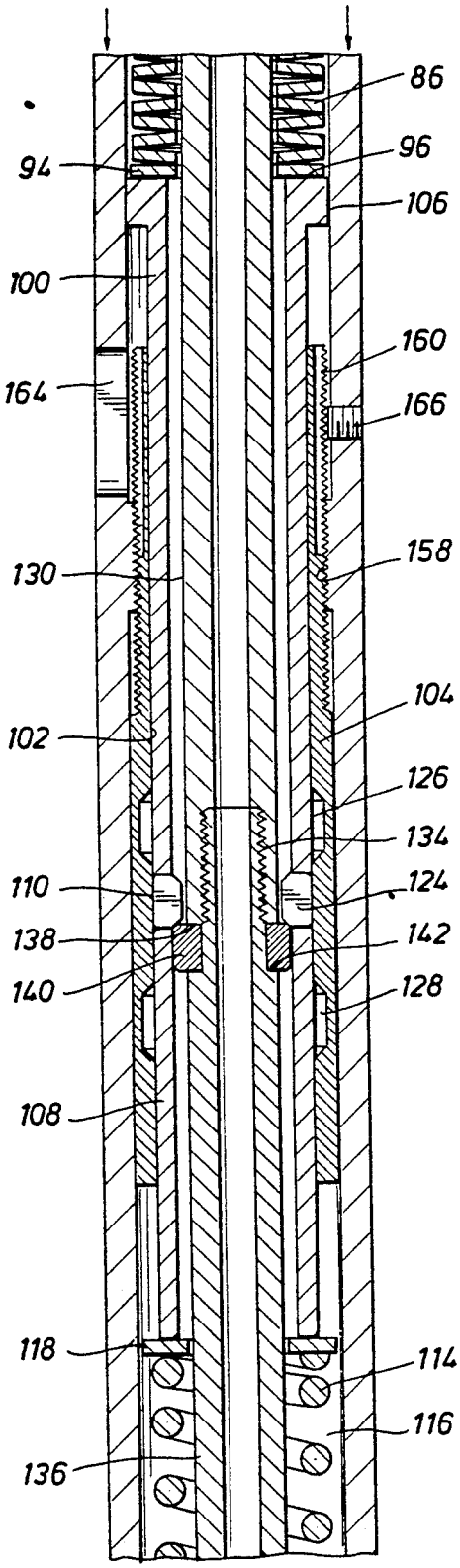

FIG. 8 is a partial sectional view illustrating the intermediate portion of the down jar mechanism with the components thereof being illustrated in the cocked position.

Figure 9:
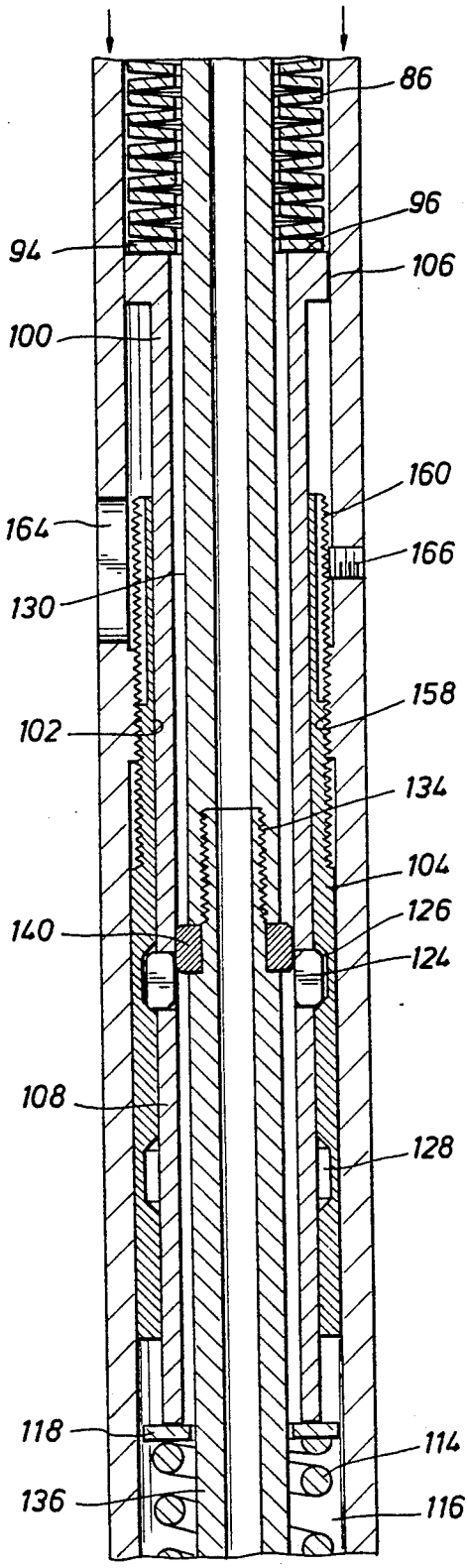

FIG. 9 is a partial sectional view similar to that of FIG. 8 and showing the components of the down jar mechanism in the released or firing position.

Figure 10:
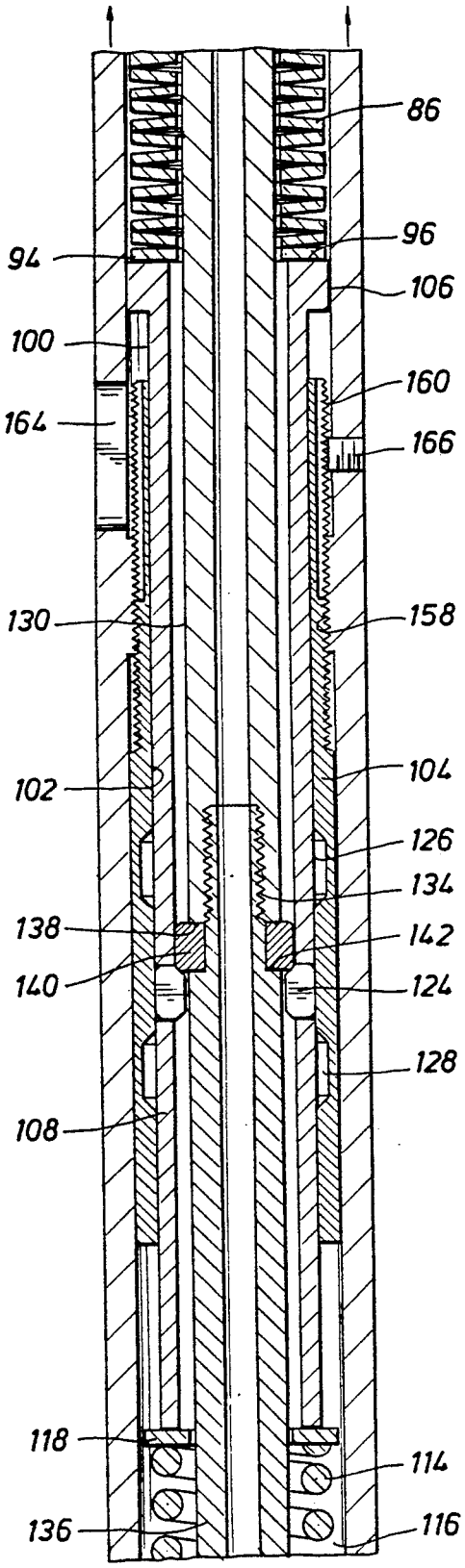

FIG. 10 is a partial sectional view similar to that of FIGS. 8 and 9 and illustrating the components of the down jar mechanism during re-cocking activity with force being applied in the upward direction on the outer housing.

Figure 11:
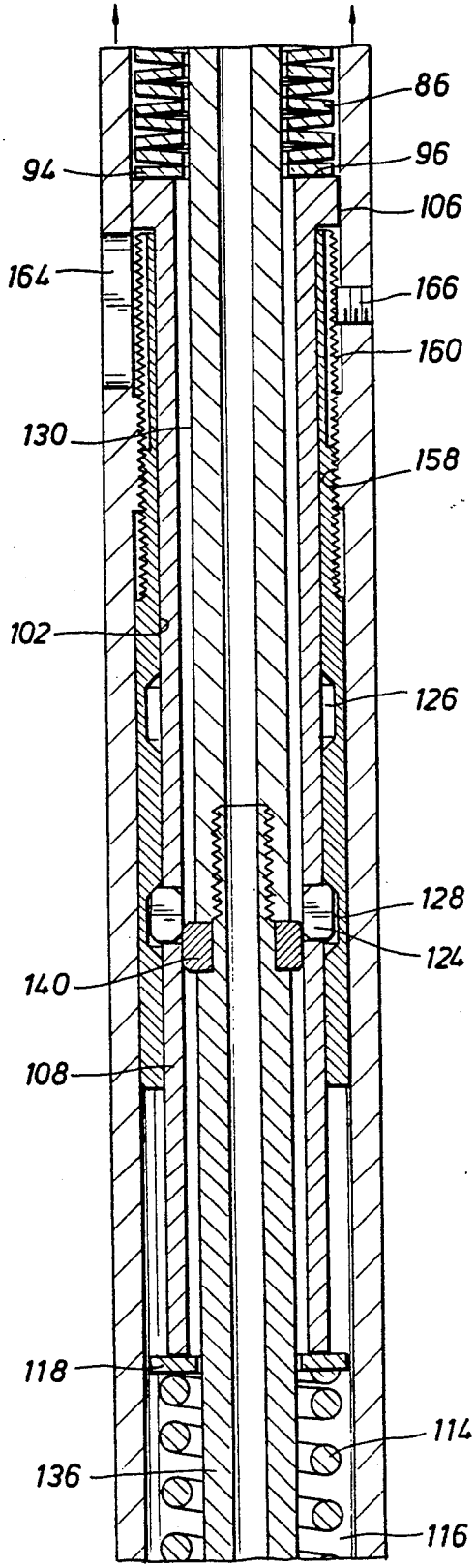

FIG. 11 is a partial sectional view similar to that of FIG. 10 and illustrating the components of the down jar mechanism at the re-cocked position thereof prior to application of a downwardly directed force that releases the load spring for down jarring.

DETAILED DESCRIPTION OF PREFERRED EMBODIMENT

Referring now to the drawings and first to FIGS. 1A, 1B and 1C, a mechanical down jar mechanism constructed in accordance with the present invention is illustrated generally at 10 and incorporates an elongate tubular housing shown generally at 12 which is formed by an upper housing section 14 having threaded connection at 16 with a housing spacer 18. The housing further incorporates an intermediate housing section 20 having a threaded connection at 22 with the housing spacer 18 and having at its lower end, a threaded connection at 24 with a lower housing section 26. The respective upper and lower ends of the housing 12 are formed respectively by upper and lower anvil caps 28 and 30 having threaded connection respectively at 32 with the upper housing section 14 and at 34 with the lower housing section 26. The anvil caps each define inwardly directed force transmission shoulders 36 and 38 respectively for impact by impact hammers 40 and 42 which are defined by enlargements at the inner extremities of upper and lower telescoping mandrels 44 and 46. To the upper mandrel 44 is threadedly secured a top sub 46 having a fishing neck 48 formed thereby. The top sub also incorporates a threaded connection 50 that may be utilized to attach the upper mandrel to any suitable force transmitting tool, including another similar or identical down jar if required. The lower mandrel 46 is threadedly connected at 52 with a bottom sub 54 which defines an internally threaded downwardly opening receptacle 56 for establishing threaded connection to a string of coil tubing or to any tool that may be located below the down jar mechanism.

The upper portion of the housing incorporates an internal compressive load delivery system that may be generally referred to as an inverted accelerator. The tubular housing section 18 defines an internal spring chamber 58 within which is located a compression spring system 60. The compression spring system will typically incorporate a spring stack of suitable height which is defined by a plurality of Belleville springs 62. The lower end of the compression spring system is supported by a force transmission washer 64 which bears against an upwardly directed thrust shoulder 66 formed by the upper end of the housing spacer 18. The upper end of the compression spring system 60 bears against a thrust washer 68 which in turn bears against a downwardly directed thrust shoulder 70 of the mandrel 40. The compression spring system is maintained in alignment by means of a tubular spring guide element 72 which is threadedly connected at 74 within the lower end of the upper mandrel 44. At the maximum expanded condition of the compression spring system, the lower end of the tubular spring guide 72 will be located within the upper end of an internal alignment passage 76 of the housing spacer 18. Thus, at all positions of the telescoping upper mandrel 44 the compression system remains adequately guided and centered by the tubular spring guide 72.

In order to permit the passage of fluid through the down jar mechanism to provide for continued circulation of fluid into the well during jarring activities, the top sub 46 is provided with a flow passage 78 that is in communication with a flow passage 80 of the mandrel 44 and a flow passage 82 of the tubular spring guide 72. Additionally, it should be born in mind that the alignment passage 76 of the housing spacer 18 also functions as a flow passage to facilitate circulation of fluid through the jar mechanism.

The mechanical down jar mechanism defines a load delivery system for jarring with significant force and also defines a latch mechanism or firing mechanism for releasing the sudden downwardly directed load delivery system when a predetermined downward force has been applied to the apparatus. The intermediate housing section 20 forms an internal spring chamber 84 within which is received a compression spring assembly 86 which will preferably incorporate a plurality of Belleville springs 88 having the capability of storing sufficient mechanical energy to deliver the load of the jarring mechanism. Hence, the compression spring assembly 86 is also referred to herein as the load spring.

The upper end of the compression spring assembly 86 bears against a spacer thrust washer 90 which in turn engages an internal thrust shoulder 92 defined by the lower end of the housing spacer 18. At this point, it should be noted that the compression spring assembly incorporates heavy-duty Belleville springs along most of its length and employs lighter weight Belleville springs at its upper extremity. This feature ensures that the compression spring assembly is capable of delivering sufficient force for efficient down jarring activity of high magnitude and also insures that the firing mechanism of the apparatus will have ample linear movement for efficiency of control and firing. The lower end of the compression spring assembly engages a lower thrust washer 94 which is seated against a circular thrust shoulder 96 formed by a circular enlargement 98 at the upper end of a tubular upper spacer 100. The outer cylindrical surface of the upper spacer 100 is received in close fitting relation guided within a cylindrical bore 102 defined by tubular detent body 104. The detent body thus functions as a guide to maintain the upper spacer 100 properly positioned within the housing. The large diameter upper end 98 of the upper spacer 100 also defines a circular outer peripheral surface having guided relation with the inner cylindrical surface 84 of the intermediate housing section 20. The firing mechanism of the mechanical down jar apparatus also incorporates a lower tubular spacer member 108 which is also disposed for linear movement within the intermediate housing section and is positioned and guided by the inner cylindrical surface 102 of the detent body 104. A firing lug assembly 110 which, as shown in FIG. 4, is composed of a plurality of firing lug segments 112, is positioned between the lower end of the upper spacer member 100 and the upper end of the lower spacer member 108. The upper and lower spacers cooperate to secure the firing lug segments 112 against linear movement except as permitted by simultaneous movement thereof along with the upper and lower spacer members.

The lower spacer member 108 is urged against the firing lug assembly 110 by means of a recock compression spring 114 which is maintained within a spring chamber 116. The upper end of the compression spring 114, as shown in FIGS. 1B and 1C which is typically a coil spring, bears against a thrust washer 118 seated at the lower end of the lower spacer 108. The lower end of the recock spring 114 bears against a thrust washer 120 which is supported by a circular thrust shoulder 122 forming the lower end of the spring chamber.

The firing lug assembly 110 is normally provided with external support against outward radial movement by means of a circular support land 124 which is formed by the cylindrical surface 102 being intersected by a circular, internal firing detent groove 126 and a circular internal recocking groove 128. Each of the circular grooves 126 and 128 define upper and lower tapered surfaces which establish a camming relationship between the firing ring and the firing lug assembly which, in response to a linear load, imparts radially outward force movements to each of the firing lugs. While the respective firing and recocking grooves permit radial expansion of the firing lug assembly when the spacers 100 and 108 are sufficiently moved in linear manner, the tapered groove shoulders function to achieve radial contraction of the firing lug assembly as the upper and lower spacers shift the firing lug assembly from the respective firing or recocking groove to the support land 124. These features are especially evident in FIGS. 8–11.

When in position, the respective firing lug segments 112 tend to remain in assembly by virtue of their wedge-shaped configuration as shown in FIG. 4. They can only contract radially inwardly sufficiently that their tapered side surfaces come into contact. When the firing lug assembly is restrained against radially outward movement by the circular support land 124, they are also restrained against excessive radially inward movement by the cylindrical outer surface 130 of a spring guide member 132 as shown by FIGS. 1B and 2B. The spring guide is of sufficient length that its free extremity 134 is positioned within the cylindrical passage 176 of the housing spacer 18 even when the compression spring assembly 86 has expanded to its maximum length. The spring guide member 132 is secured by a threaded connection 134 to an elongate firing ring positioning element 136 and functions to provide a circular locking shoulder 138 at the lower end thereof that secures a circular firing ring 140 in locked position against a circular, upwardly facing shoulder 142 of the firing ring positioner. The firing ring 140 is thus secured in fixed relation with the spring guide element 132 and the firing ring positioning element 136. The firing ring is fixed relative to the lower mandrel 46 so that the housing 12 and the detent body 104 are movable with respect to the firing ring during both the firing and recocking strokes thereof. The upper and lower spacers and the firing lug assembly are also linearly movable relative to the fixed firing ring.

The lower body section 26 as shown in FIGS. 1C and 2C forms an inner cylindrical surface 144 which defines an elongate chamber 146 within which the upper end of the lower telescoping mandrel 46 is movably received. The circular enlargement 42 at the upper end of the lower mandrel 46 defines an outer cylindrical guide surface 148 having close fitting guiding relation with the inner cylindrical surface 144. The lower mandrel cap 30 also defines an internal cylindrical guide surface 150 having close fitting guided relation with the outer cylindrical surface 152 of the lower mandrel. The housing is thus efficiently guided by the close fit of the lower anvil cap with the cylindrical lower mandrel.

The firing ring positioning mandrel 136 has its lower end fixed to the upper end of the lower mandrel 46 by means of a threaded connection 154. A set screw 156 secures the mandrel 46 and the firing ring positioning mandrel against relative rotation and thereby secures the threaded connection 154 against inadvertent disassembly. The lower housing section 26 is provided with a port 158 as shown in FIGS. 1C and 2C that allows rapid egress of fluid from within chamber 146 upon firing of the jarring mechanism. This feature prevents any degree of hydraulic resistance from interfering with the force transmitted by the mechanical down jar during jarring activity.

The load of the firing mechanism is adjustable by virtue of relative positioning of the firing groove 126 and the land 124 within the intermediate housing section. To accomplish such adjustment, as shown in FIGS. 1B, 2B and 8–11 the intermediate housing section is provided with an internal detent adjustment thread 158 and the tubular detent body 104 is provided with a mating external adjustment thread 160. As is evident from FIG. 3, the detent body is also provided with a plurality of external longitudinal ridges and grooves or splines 162 that are accessible through a detent positioning port 164. A suitable adjustment tool, such as a screwdriver, pry bar or the like, is inserted through the port 164 and brought into contact with the external splines 162. The tool is used in the nature of a pry bar to apply rotary force to the detent body 104 thus rotating the detent body relative to the internal thread 158 of the intermediate housing section and thus, by virtue of the threaded connection, imparting linear movement to the detent body to adjust its position within the lower body of the down jar and thus alter the spring force that occurs during jarring. The direction of linear detent body movement is of course determined by the direction of rotation of the detent body by the adjustment tool. After the detent body has been properly adjusted, it may be locked in position by means of a set screw 166 or my any other suitable means.

To permit the flow of fluid through the mechanical down jar mechanism, passages 168, 170, 172 and 174 are formed respectively in the spring guide mandrel 132, the firing ring positioning mandrel 136, the bottom telescoping mandrel 46 and the bottom sub 54. These passages form a single straight through flow passage disposed in communication with the passage 76 of the housing spacer and with the flow passage that is cooperatively defined by passages 78, 80 and 82. Thus, fluid can flow at any suitable velocity through the down jar mechanism hereof such as for cleaning the upper end of a stuck object, removing debris that might be covering the stuck object or treating the well bore at a level below the down jar mechanism.

Referring now to FIG. 6, it should be born in mind that the mechanical down jar mechanism of this invention may be equally well suited for use as a snubber or drilling jar by providing appropriate splined interconnection between the housing and the telescoping upper and lower subs so that rotary force may be transmitted through the down jar mechanism to apparatus located below it. As shown in FIG. 6, the housing 176 is provided with a lower anvil cap 178 having internal splines 180 that mate with external splines 182 that are defined by the lower telescoping mandrel 184. Thus, as the housing 176 is rotated, rotational force is transmitted from the lower anvil cap 178 to the lower telescoping mandrel 184 through the splined interconnection therebetween. Although only a splined connection as shown in the bottom of the down jar mechanism of FIG. 6, it is to be born in mind that the upper telescoping mandrel will also have a splined interconnection with the upper anvil cap 28 at the upper portion of the housing structure 12.

OPERATION

In most cases, a coil tubing fishing string consists of (starting from the bottom up) an overshot or spear, an accumulator when used, an up or conventional jar mechanism, a down jar mechanism and an accelerator. When a fish is stuck within the well bore a coil tubing fishing string is utilized to latch onto the fish. After latching has occurred, the up jar is employed to achieve upwardly directed jarring to release and remove the fish from the hole. Repeated jarring may be necessary in order to release the fish from its stuck position to allow it to be retrieved.

In the event upwardly directed jarring can not loosen and retrieve the fish, it will be appropriate to jar in the opposite direction to loosen the fish in the downward direction. Heretofore, downward jarring in connection with coil tubing has not ordinarily been within the capability of fishing equipment.

To accomplish down jarring activity, according to the present invention, the operator will pick up the pipe weight as shown in FIGS. 10 and 11 in order to cock the down jar mechanism. The weight of the pipe is then placed on the tool string as shown by FIGS. 8 and 9. The upper part of the down jar mechanism will move downwardly in telescoping manner and will start closing the jar mechanism. This activity will accomplish storage of energy in the upper portion of the housing through compression of the compression spring system 60. The adjustable latch mechanism within the lower portion of the housing will resist downward movement of the housing relative to the lower mandrel. When stored energy of the Belleville spring 88 overcomes the setting of the latch assembly, the jar mechanism releases and all of the stored energy in the upper body section is released to the outer body. The outer body then travels downwardly at high velocity and strikes the bottom sub 54. This may be repeated by again picking up the pipe weight sufficiently to achieve recocking of the latch mechanism. By again lowering the pipe weight, the down jar mechanism will fire or release as soon as its predetermined load setting is exceeded by the stored energy of the load spring assembly, thereby again jarring the housing against the upwardly directed shoulder of the bottom sub. This can be done as often as necessary. It usually takes three or four down jar strokes to release fishing tools after the fishing tools have been jarred upwardly a number of times.

Assuming that the down jar mechanism is in the cocked position as shown in FIGS. 1A, 1B and 1C, as the pipe weight is then set down, force is applied to the upper telescoping mandrel 44 to the compression spring system 60, thus collapsing the compression spring system to the degree permitted by the Belleville load spring assembly. The spring guide 72 will therefore be forced more into the internal passage of the housing spacer 18 as is evident in FIG. 1A. The force applied to the compression spring system is translated to the upwardly directed shoulder 66 of the housing spacer 18 and is also translated by the downwardly directed thrust shoulder 92 to the compression spring assembly 86. This downwardly directed force is applied from the compression spring assembly 86 to the spacer and firing lug assembly as shown in FIGS. 8 and 9, thereby moving the firing lug assembly downwardly until it comes into contact with the firing ring 140. At this point, further downward movement of the firing lug assembly is restrained by the firing ring. Further, by virtue of the tapered interengaging surfaces of the firing lug assembly and the firing ring, a radially outwardly directed force movement is developed on the firing lug assembly which, except for the presence of the supporting land 124, will cause the firing lug assembly to expand radially outwardly. It should be noted that the firing ring 140 will not move under this condition, because of its fixed relation to the firing ring positioning mandrel 136 which is in turn disposed in fixed relation with the fish by virtue of its fixed relationship with the lower telescoping mandrel 46.

As the downwardly directed force continues to increase, the housing will be moving downwardly as permitted by compression of the load spring system 86 and the detent body 104 will be moving downwardly with the housing. Eventually, as the downward force increases, the compression spring assembly 86 will have been loaded with to maximum extent as determined by the releasing or firing setting of the latch mechanism. Downward movement of the housing 12 continues until the firing groove 126 is brought into registry with the firing lug assembly as shown by FIG. 9. When this occurs the individual firing lug segments 112 will then be suddenly moved radially outwardly by virtue of the camming engagement between the tapered surfaces of the firing lug segments and the firing ring. Movement of the firing lug segments 112 into the firing groove 126 will suddenly release the axial restraint of the firing lug assembly and the firing ring, thus releasing the housing to be driven rapidly downwardly under the force of the compression spring assembly 86. The firing lug assembly, because of its radial expansion, will move downwardly past the firing ring as the housing 12 moves rapidly downwardly. Downward housing movement will continue until the lower mandrel cap 30 comes into striking contact with the upwardly directed shoulder of the bottom sub 54. this striking force is controlled by the adjustment setting or releasing force of the firing assembly of the latch mechanism and its compression spring. The springs 86 and 114 will cooperate immediately after firing to return the firing lug assembly to its contracted condition so that it is radially supported by the circular land 124 as shown in FIG. 10.

With the jarring mechanism now in the "fired" position shown in FIGS. 2A, 2B and 2C, and FIG. 10 recocking of the firing assembly is achieved by applying an upwardly directed force to the housing 12. At the surface, the operator will lift the pipe weight from the jarring mechanism, thereby imparting an upwardly directed force to the housing 12. When this occurs, the firing lug assembly of the latch mechanism is moved upwardly until it comes into contact with the firing ring 140. Here again, the engagement that takes place between the firing lug assembly and the firing ring imparts a radially directed force as well as a linearly directed force to the firing lug assembly. The linearly directed upward force is translated from the housing to the lower spacer member 108 and to the recocking spring 114. As the recocking spring is compressed, the detent body 104 will be moved upwardly relative to the restrained firing lug assembly, thus bringing the recocking groove 128 into registry with the outer periphery of the firing lug assembly as shown in FIG. 11. When this has occurred, the radially directed force applied to the firing lug assembly will suddenly move all of the segments 112 of the firing lug assembly into the recocking groove 128. When this has been accomplished, the firing lug assembly will move past the firing ring 140 as shown, in FIGS. 1A, 1B and 1C and FIG. 11. Simultaneously, the force of the compression spring 114, acting upon the lower spacer 108, will immediately shift the firing lug assembly to its restrained position in relation to the cylindrical surface 124 defined by the internal land of the detent body. In this condition, the apparatus is again ready for another down jarring stroke. As mentioned above, down jarring may be continued repetitively as long as desirable without causing damage or deterioration to the jarring mechanism. The down jar mechanism will make coil tubing, fishing and releasing, equal to wireline releasing tools. However, coil tubing can pull 10–11 times more than typical wireline retrieving systems. Additionally, fluid may be circulated through the down jar mechanism which is a significant advantage over conventional down jarring devices.

The compression spring system 60 will function in the nature of an inverted accelerator to enhance the jarring activity that takes place. As downward force is applied through the upper telescoping mandrel, the compression spring system 60 is compressed so that the downward force applied to it is transmitted to the housing 12. When release or firing of the latch mechanism occurs, the compression spring induces additional downward impetus to the housing. Since the compression spring assembly 160 is of lighter compressive weight, the spring system 60 induces delayed downward impetus to the housing, thus lengthening the duration of the downward shock pulse of the down jar mechanism against the object to be moved. This feature enhances use of the down jar for achieving insertion of coil tubing into deviated or horizontal well bores.

The down jar mechanism is not limited to running with fishing tools on coil tubing. It may be run to release locking mandrels, broaching tools, shear pins and may also be employed to jar down to free a fish from its stuck position within a well bore. Further, mechanism may be used in connection with one or more other down jars and it may also be employed in conjunction with up jar mechanisms. The apparatus may also be employed for drilling and snubbing activities, assuming that it incorporates splined connections as shown in FIGS. 6 and 7.

In view of the foregoing, it is evident that the present invention is one well adapted to attain all of the objects and features hereinabove set forth, together with other objects and features which are inherent in the apparatus disclosed herein.

As will be readily apparent to those skilled in the art, the present invention may be produced in other specific forms without departing from its spirit or essential characteristics. The present embodiment, is therefore, to be considered as illustrative and not restrictive, the scope of the invention being indicated by the claims rather than the foregoing description, and all changes which come within the meaning and range of the equivalence of the claims are therefore intended to be embraced therein.

What is claimed is:

1. A mechanical down jar mechanism for freeing stuck objects within a well bore and for conducting other down hole activities, comprising:

(a) an elongate tubular housing having anvil means;

(b) mandrel means adapted for connection to an object to be moved downwardly within the well bore and being disposed in telescoping relation with said anvil means and said elongate tubular housing, said mandrel means adapted to be struck by said anvil means to impart a downwardly directed jarring force to said object;

(c) said elongate tubular housing having internal firing and recocking detent groove means located in axially spaced relation and forming a firing lug support land therebetween;

(d) a radially expandable and retractable firing lug assembly being disposed within said elongate tubular housing and in absence of force being applied axially thereto being radially restrained by said firing lug support land;

(e) load spring means being disposed within said elongate tubular housing and being in downward force transmitting relation with said firing lug assembly;

(f) recocking spring means being disposed within said elongate tubular housing and having upward axial force transmitting relation with said firing lug assembly; and (g) a firing ring being supported in substantially immovable relation with said mandrel means and being positioned for contact by said firing lug assembly, upon predetermined application of downward force to said elongate tubular housing and said load spring means, said firing detent groove being moved downwardly into registry with said firing lug assembly, thus permitting radial expansion of said firing lug assembly into said firing detent groove and permitting rapid downward jarring movement of said anvil means of said elongate tubular housing by said load spring means against said mandrel means, upon application of predetermined upward force to said elongate tubular housing and said recocking spring means with said firing lug assembly in its fired condition said recocking detent groove means moving upwardly into registry with said firing lug assembly, thus permitting radial expansion of said firing lug assembly into said recocking detent groove and permitting upward movement of said firing lug assembly past said firing ring to the cocked position thereof.

2. The mechanical down jar mechanism of claim 1, wherein:

a detent body is disposed within said elongate tubular housing and is of tubular form defining said firing and recocking detent groove means and said firing lug support land internally thereof.

3. The mechanical down jar mechanism of claim 2, wherein:

the position of said detent body means is adjustable within said elongate tubular housing to thus provide adjustment of the compression of said load spring means and thus adjustment of the impact force of said elongate tubular housing on said mandrel means at firing.

4. The mechanical down jar mechanism of claim 2, wherein:

(a) said detent body having threaded engagement within said elongate tubular housing and defining a plurality of spaced grooves and lands about the external periphery thereof; and (b) said elongate tubular housing forming an access opening exposing at least one of said ridges and grooves of said detent body to permit rotation of said detent body relative to said elongate tubular housing for linear adjustment of said detent body to achieve adjustment of the firing force of said load spring means.

5. The mechanical down jar mechanism of claim 1, wherein:

(a) said radially expandable and retractable firing lug assembly comprises a plurality of tapered firing lug segments disposed in a generally circular arrangement, each of said firing lug segments having an outer surface normally disposed in restraining engagement with said firing lug support land;

(b) upper and lower tubular spacer elements each being disposed in axial engagement with said plurality of firing lugs;

(c) the upper end of said upper tubular spacer member having force transmitting engagement with said load spring means; and (d) the lower end of said lower tubular spacer member having force transmitting engagement with said recocking spring means.

6. The mechanical down jar mechanism of claim 1, wherein:

said firing ring is supported in fixed relation by said mandrel means and functions to restrain axial movement of said radially expandable and retractable firing lug assembly until sufficient downward load has been applied to said elongate tubular housing to sufficiently compress said load spring so that said firing detent groove means is positioned in registry with radially outwardly into said firing detent groove means enabling said firing lug assembly to clear said firing ring and release said elongate tubular housing for rapid downward impacting movement with said mandrel means.

7. The mechanical down jar mechanism of claim 6, wherein:

(a) said mandrel means defines at least a lower mandrel disposed in telescoping relation with said elongate tubular housing;

(b) a firing ring positioning mandrel being fixed to said lower mandrel and projecting in axially extended relation therefrom; and (c) said firing ring being positioned within said elongate tubular housing by said firing ring positioning mandrel.

8. The mechanical down jar mechanism of claim 7, including:

a spring guide mandrel projecting in fixed relation from said firing ring positioning mandrel and projecting through said load spring means and maintaining alignment of said load spring means within said elongate tubular housing, said spring guide mandrel locking said firing ring in immovable assembly with said firing ring positioning mandrel.

9. The mechanical down jar mechanism of claim 1, wherein:

(a) said mandrel means comprises upper and lower mandrels disposed in movable telescoping relation with said elongate tubular housing, said lower mandrel having an upwardly directed striking shoulder disposed for jarring contact by said elongate tubular housing;

(b) accelerator spring means being disposed within said elongate tubular housing and having force transmitting relation therewith; and (c) said upper mandrel having force transmitting relation with said accelerator spring means for application of downwardly directed force through said accelerator spring means to said elongate tubular housing.

10. The mechanical down jar mechanism of claim 1, wherein:

said mandrel means having splined connection with said elongate tubular housing, thus permitting axial telescoping movement of said elongate tubular housing and said mandrel means and permitting non-rotatable force transmitting relation between said elongate tubular housing and said mandrel means.

11. The mechanical down jar mechanism of claim 1, wherein:

said mechanical down jar mechanism forms a flow passage completely therethrough to permit circulation of fluid through said mechanical down jar mechanism.

12. The mechanical down jar mechanism of claim 1, wherein:

said mandrel means comprises upper and lower force transmitting mandrels each having telescoping relation with said elongate tubular housing, said upper and lower mandrels each defining flow passage means therethrough and cooperating with said elongate tubular housing to define a longitudinal flow passage permitting circulation of fluid through said mechanical down jar mechanism while the same is located within a well bore.

13. A method for freeing a stuck object within a well bore through employment of a mechanical down jar mechanism having a tubular housing and at least a lower mandrel being disposed in telescoping relation with said tubular housing and being connectable to said stuck object, said mechanical down jar mechanism incorporating an internal load spring assembly and an internal firing assembly releasing said housing for sudden downward jarring movement against said mandrel by said load spring assembly, said mechanical down jar mechanism further defining a circulation passage for flow of liquid therethrough, said method comprising:

(a) connecting the upper end of said mechanical down jar mechanism to the lower end of coiled tubing;

(b) connecting a fishing tool to the lower end of said mandrel means for attachment to said stuck object;

(c) extending said fishing tool and said mechanical down jar mechanism downwardly through a well bore until said fishing tool establishes coupled relation with said stuck object;

(d) with said mechanical down jar mechanism in its cocked condition, applying a downward force to said housing to compress said load spring to the firing load thereof;

(e) actuating said firing mechanism, permitting rapid downward jarring movement of said housing means against said mandrel to impart the downward jarring force to said fishing tool and said stuck object; and (f) raising said housing means relative to said mandrel means to recock said firing mechanism and ready said mechanical down jar mechanism for a subsequent jarring cycle.

14. The method of claim 13, wherein said firing mechanism of said mechanical down jar mechanism comprises a plurality of firing lugs disposed in circular orientation and normally being restrained by a circular firing lug support land against radially outward movement, said housing means forming spaced internal firing and recocking grooves, said method including:

(a) achieving sufficient downward movement of said housing means during compression of said load spring to bring said firing lugs into registry with said firing lug groove permitting radial expansion of said firing lugs to positions releasing said restraint of downward movement of said housing by said firing ring; and (b) during upward movement of said housing relative to said mandrel, sufficient upward force being applied to bring said recocking groove into registry with said plurality of firing lugs, thus permitting radial expansion of said firing lug assembly to permit linear upward movement of said firing lug assembly past said firing ring for recocking of said firing mechanism.

* * * * *